United States Patent [19]

Dearling

[11] 3,980,203

[45] Sept. 14, 1976

[54] FRAGRANCE DISPENSER

[76] Inventor: Harry S. Dearling, 25 E. 83rd St., New York, N.Y. 10028

[22] Filed: Nov. 25, 1974

[21] Appl. No.: 526,816

[52] U.S. Cl. ..... 221/96; 239/289

[51] Int. Cl.[2] ..... B05B 13/00

[58] Field of Search ..... 239/34, 326, 289; 221/96; 222/173, 182; 206/229, 233, 45.19, 486, 489, 199; 21/74 R; 118/325

[56] References Cited

UNITED STATES PATENTS

| | | | |
|---|---|---|---|
| 2,913,101 | 11/1959 | Daily | 206/45.19 |
| 3,347,354 | 10/1967 | West | 206/199 X |
| 3,707,945 | 1/1973 | Boone | 118/325 X |
| 3,865,271 | 2/1975 | Gold | 221/96 |

*Primary Examiner*—Robert B. Reeves
*Assistant Examiner*—John P. Shannon
*Attorney, Agent, or Firm*—Curtis, Morris & Safford

[57] ABSTRACT

A scent dispensing device comprising a container to discharge a quantity of a suitable fragrance, such as a perfume or a deodorizer, a card-like carrier member capable of absorbing a fragrance sprayed onto it from the container, and a holder for the fragrance container and the carrier member which positions the carrier member with respect to the discharge source of the fragrance container.

5 Claims, 3 Drawing Figures

FIG. 2
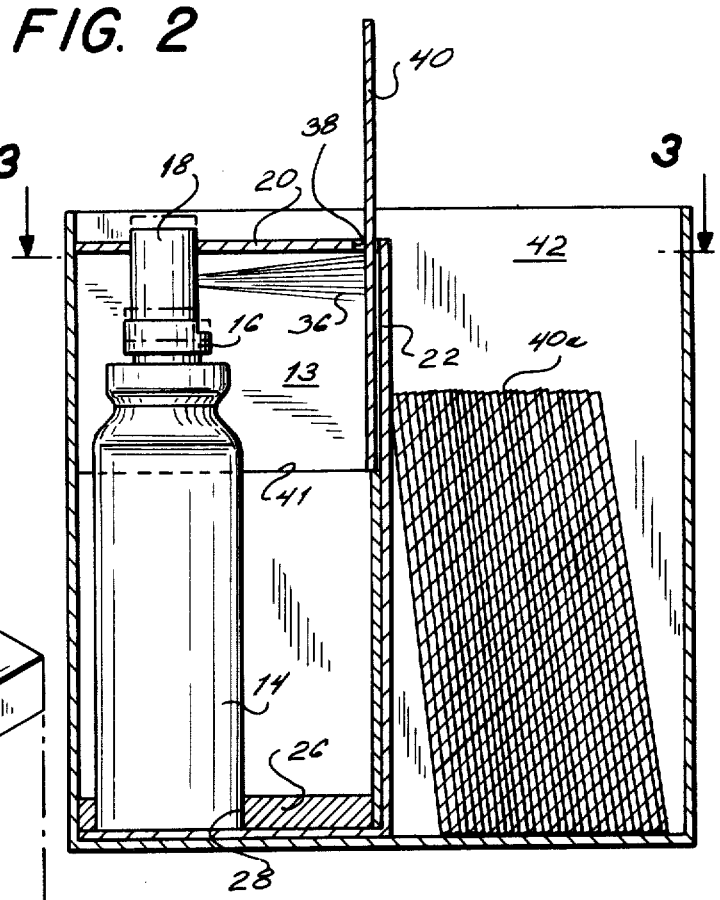
FIG. 1
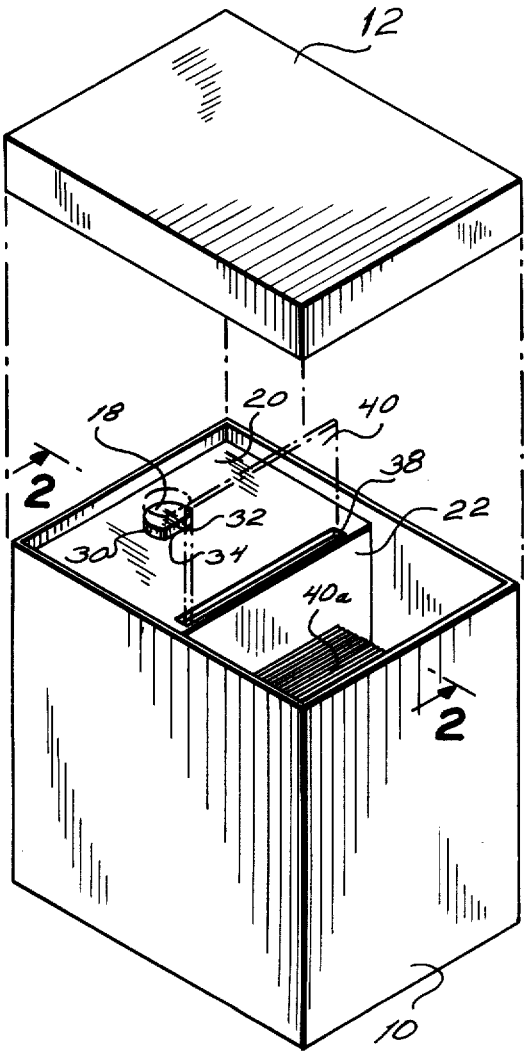
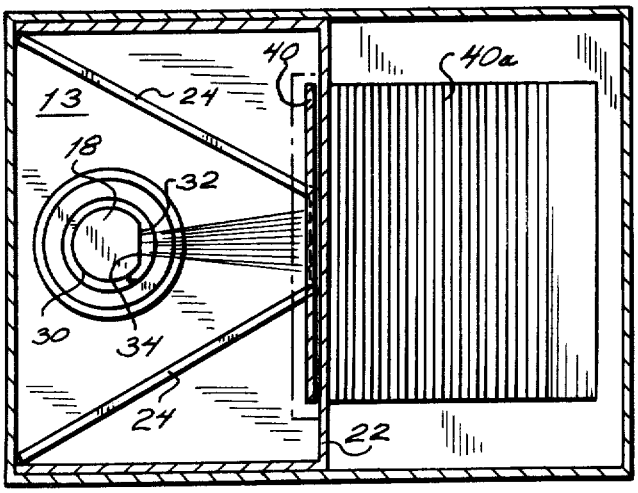
FIG. 3

FRAGRANCE DISPENSER

This invention relates to a scent dispensing device, and more particularly to a device that dispenses a measured quantity of a spray fragrance onto a card-like carrier that can be carried by a person or placed somewhere to provide a pleasant scent.

Broadly, the invention comprises a container adapted to discharge a quantity of a suitable fragrance, such as a perfume or a deodorizer, a card-like carrier member capable of absorbing or adsorbing a fragrance sprayed onto it from the container, and a holder for the fragrance container. The holder is constructed to receive and position the carrier member with respect to the discharge source of the fragrance container so that the fragrance may be discharged onto the carrier member. Such devices have a number of uses, including particularly to provide a pocket or purse sachet, a sachet that can be put in closets and/or dressers, and for use to provide samples of perfume or cologne scents in retail stores. The latter usage is advantageous for a number of reasons. It avoids a shopper's having to spray a number of perfume samples onto her skin or clothes, which cannot readily be removed and which also tends to impair the ability to distinguish one scent from another. In addition, by providing a controlled discharge of the perfume or cologne onto a carrier member the quantity of perfume or cologne dispensed for sample purposes may be materially reduced as the carrier member provides a sufficient indication of the fragrance while utilizing a small quantity of the perfume or cologne. Another use is for dispensing pharmaceutical preparations intended to be inhaled.

These and other objects and advantages of the present invention will become more readily apparent after consideration of the specification and accompanying drawing wherein:

FIG. 1 is an exploded perspective view showing a fragrance dispensing device according to the present invention;

FIG. 2 is an elevational view, partly in section, showing a fragrance container and card-like carrier member; and FIG. 3 is a plan view, partly in section, of the fragrance dispensing device of the present invention.

As best seen in FIG. 1, the fragrance dispensing device of the present invention includes a box-like case or housing 10 onto which a cover 12 may be fitted. A section 13 is provided within a portion of the housing 10 adapted to receive and house a fragrance dispensing container 14. Container 14 may be a pressurized container having a metered dispensing valve 16 actuated by a plunger member 18 so that upon depressing the plunger 18, valve 16 permits a predetermined quantity of the fragrance to be dispelled. Alternatively container 14 may be of the squeeze type, that is, actuated by a plunger or a squeeze bulb (not shown) to spray out a predetermined quantity of the fragrance by actuating the plunger or squeezing the bulb.

The section 13 within housing 10 to receive container 14 is formed by a horizontal partition piece 20 and a vertical position piece 22 supported by suitable vertically disposed brace members 24. As seen in FIG. 2, the vertical extent of brace members 24 is less than the vertical extent of position piece 22. A base support member 26 with a cut-out segment 28 to accommodate the base of the container 14 is also provided to positively support and fix container 14 within section 13.

Horizontal partition piece 20 is provided with an opening 30 through which plunger 18 extends for ready access. The opening 30 may be eccentrically shaped, as at 32, to correspond to a corresponding eccentricity 34 in plunger 18 to positively hold container 14 and preclude its rotation so that the discharge orifice of the valve 16 and the discharged spray 36 are always directed in the correct orientation. Other methods of holding the container against rotation, for example, a non-circular container in a base support member 26 having an opening 28 corresponding thereto, will be readily apparent.

Partition 20 is also provided with a slotted opening 38 adjacent the juncture of partition pieces 20 and 22 through which a card-like carrier member 40 is inserted. Brace members 24, since their vertical extent is less than the vertical extent of partition piece 22 provide a supporting surface 41 for the carrier member 40. The discharge orifice of the container discharge valve 16, of course, is oriented so that the spray 36 impinges directly on the carrier when it has been inserted through slot 38 and rests on surfaces 41. After a predetermined quantity of the fragrance has been discharged onto carrier member 40, the carrier member is removed and may be used for any of the purposes mentioned heretofore and others that will be apparent.

The remaining section 42 of housing 10 may be utilized for storage of a plurality of card-like carrier members 40a.

As materials for construction of the housing 10, partitions 20, 22, base member 26 and brace pieces 24, there can be used various metals, woods, plastics, cardboards and the like, and combinations thereof. A reasonable degree of rigidity of the materials is obviously desirable. Containers of fragrances are well-known and commercially available, and many varieties of them can be utilized. As card-like carrier members, many materials can be used. Desirably the material selected should be able to absorb or adsorb the spray of fragrance to avoid messiness. Thus the material should have some degree of porosity. Various forms of cardboard are convenient, economical and suitable materials, and are presently preferred as material for the carrier.

Modifications of the materials and construction of the embodiments of the invention described and illustrated herein will be apparent to persons skilled in the art, and can be made without departing from the scope of the invention as disclosed above and claimed in the appended claims.

What is claimed is:

1. A fragrance dispensing device comprising a housing to retain a fragrance container having discharge valve means and means to actuate said valve means to discharge a predetermined quantity of said fragrance as a spray, partition means fixed within said housing to define a fragrance container receiving segment within said housing to positively retain and position the said fragrance container, removable carrier means adapted to receive said spray of said fragrance, means within said housing to position and orient said carrier means whereby when said discharge valve means on said container is actuated said spray of fragrance impinges on said carrier means within said housing, said partition means comprising a first vertically disposed partition member within said housing and a second horizontally disposed partition member secured between the top of said first partition member and a wall of said housing, and a pair of vertically disposed brace members having a vertical extent less than the vertical extent of said first partition member, said brace members being angularly disposed and connected between said first partition member and said wall of said housing thereby to define the fragrance container receiving area.

2. A fragrance dispensing device as defined in claim 1 including base plate means disposed within said fragrance container receiving area including a receiving opening therein to receive said fragrance container and positively fix the orientation of said container therein.

3. A fragrance dispensing device as defined in claim 1 wherein said second partition means includes an eccentrically shaped opening therein complementary to the configuration of said means to actuate said discharge valve means in said fragrance container thereby to fix said fragrance container within said fragrance container receiving area and orient the direction of spray of said fragrance.

4. A fragrance dispensing device as defined in claim 1 wherein said first partition member is spaced between said wall of said housing and an opposite wall of said housing to define a receiving area to receive and hold a plurality of said carrier means.

5. A fragrance dispensing device as defined in claim 1 wherein said means to position and orient said carrier means within said device to have said fragrance spray impinge thereon comprises a slot formed within said second partition means adjacent the juncture of said first and second partition means whereby when said carrier means is positioned within said slot the lower surface of said carrier means rests upon the upper surface of said brace members thereby to orient and support said carrier means in the path of fragrance spray.

* * * * *